US009672704B2

(12) United States Patent
Connell, II

(10) Patent No.: US 9,672,704 B2
(45) Date of Patent: Jun. 6, 2017

(54) EMERGENCY SYSTEM TEXTUAL NOTIFICATION DEVICE WITH ALERT MECHANISM

(71) Applicant: Tyco Fire & Security GmbH, Neuhausen am Rheinfall (CH)

(72) Inventor: Thomas W. Connell, II, Westminster, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 14/670,921

(22) Filed: Mar. 27, 2015

(65) Prior Publication Data

US 2016/0284174 A1 Sep. 29, 2016

(51) Int. Cl.
*G08B 7/00* (2006.01)
*G08B 7/06* (2006.01)

(52) U.S. Cl.
CPC ..... *G08B 7/066* (2013.01); *G08B 7/062* (2013.01)

(58) Field of Classification Search
CPC .... G08B 25/004; G08B 23/00; G08B 25/003; G08B 7/066
USPC ..... 340/691.6
See application file for complete search history.

(56) References Cited

U.S. PATENT DOCUMENTS 5,790,019 A * 8/1998 Edwin ..... G08B 7/06 340/286.02
6,317,042 B1 * 11/2001 Engelhorn ..... G08B 7/062 340/288
6,809,642 B1 * 10/2004 Brenner ..... G08B 7/062 340/3.1
8,319,625 B2 11/2012 Farley et al.
2004/0246144 A1 * 12/2004 Siegel ..... G08G 1/0965 340/902
2008/0266121 A1 * 10/2008 Ellul ..... G08B 7/066 340/584
2012/0119921 A1 * 5/2012 Farley ..... G08B 27/005 340/691.6
2013/0041646 A1 2/2013 Farley et al.
2013/0331058 A1 * 12/2013 Harvey ..... H04W 4/22 455/404.2

(Continued)

OTHER PUBLICATIONS

"Fire Alarm Specification." Simplex MIS Dept., Apr. 3, 2009. 15 pages.

(Continued)

*Primary Examiner* — Don N Vo
(74) *Attorney, Agent, or Firm* — HoustonHogle LLP

(57) ABSTRACT

A textual notification device includes a display for presenting either emergency information or non-emergency information received at the network interface of the textual notification device. The textual notification device also includes an alert mechanism for generating an alert signal alerting occupants to the presentation of emergency information. The textual notification device can be incorporated in an emergency system that includes an emergency panel and a secondary system. The emergency panel provides the emergency information to the textual notification device for display. The secondary system provides the non-emergency information to the textual notification device for display. In one embodiment, the emergency system includes an addressable channel enabling the separate addressing of the display and the alert mechanism(s).

10 Claims, 5 Drawing Sheets

(56) References Cited

U.S. PATENT DOCUMENTS

| | | | | |
|---|---|---|---|---|
| 2014/0139539 | A1* | 5/2014 | Byers | G09G 5/10 345/589 |
| 2014/0211667 | A1* | 7/2014 | Hochendoner | H04L 12/1895 370/259 |
| 2014/0320282 | A1* | 10/2014 | Zhang | G08B 7/066 340/502 |

OTHER PUBLICATIONS

"Simplex TrueAlert Emergency Visual Messaging Display." SimplexGrinnell, 2007. 2 pages.

* cited by examiner

EMERGENCY SYSTEM TEXTUAL NOTIFICATION DEVICE WITH ALERT MECHANISM

BACKGROUND OF THE INVENTION

Many buildings include textual notification devices for displaying information in the form of text messages. The textual notification devices are used to display information to occupants of the building. For example, university buildings often include textual notification devices for displaying information on school activities to students. In another example, restaurant buildings include textual notification devices for displaying information on food specials and local news to customers.

Some buildings include emergency systems. Emergency systems are used to monitor emergency conditions (e.g., fire, robbery, gas leak, etc.) for the building. The emergency systems alert occupants of a particular emergency based on monitoring of the emergency conditions. Emergency systems typically include an emergency panel, initiation devices, and standard notification devices connected to one another via an emergency network. For example, the emergency panel monitors an emergency condition (e.g., fire) by using the initiation device (e.g., smoke detector). The emergency panel responds to the emergency condition (e.g., fire) by activating the notification device (e.g., activating an audio alert generator).

Some emergency systems include textual notification devices connected to the emergency network. These textual notification devices are used to present emergency information (e.g., fire alert or gas alert). These devices are especially critical when there is a need to notify the hearing-impaired.

These textual notification devices can also provide non-emergency information (e.g., school activities, food specials, local news, etc.) as described above so long an emergency information override feature is included. The textual notification devices use the emergency information override feature to override the presentation of non-emergency information when emergency information is received.

SUMMARY OF THE INVENTION

One problem that is arises when textual notification devices are used to provide non-emergency information is that when emergency information is finally presented on textual notification devices, there is a risk that it will be overlooked by occupants. For example, in some cases, occupants are not aware that a textual notification device has switched from the presentation of non-emergency information to the presentation of emergency information, or the occupants may have been so habituated to expecting non-emergency information there is no expectation otherwise.

The present invention provides a solution to this problem. The present invention offers an emergency system and method that provides alert signals for alerting occupants to the presentation of emergency information. In particular, the emergency system includes a textual notification device having an alert mechanism for generating an alert signal for alerting occupants as to an emergency message being displayed on the textual notification device. The present invention is directed toward further solutions to address this need, in addition to having other desirable characteristics.

In general, according to one aspect, the invention features a textual notification device that includes a network interface for receiving emergency information and non-emergency information, a display for presenting either the emergency information or the non-emergency information received at the network interface, and an alert mechanism for generating an alert signal for alerting occupants to the presentation of the emergency information. The alert signal typically corresponds with a particular emergency condition. In one embodiment, the display is a light emitting diode (LED) or other display device signboard.

In one embodiment, the alert mechanism includes an audio alert generator for generating the alert signal in the form of an audible signal. In another embodiment, the alert mechanism includes a visual alert generator for generating the alert signal in the form of a visible signal. In still another embodiment, the alert mechanism includes an audio alert generator and a visual alert generator for generating the alert signal in the form of an audible signal and a visible signal, respectively.

Preferably, the audio alert generator and the visual alert generator are each coupled to an addressable channel such that the audio alert generator has an address unit that is different than an address unit of the visual alert generator. The different address units enable the visual alert generator and the audio alert generator to be individually addressable and thus separated controlled/activated.

Further, the alert mechanism and the display are preferably coupled to an addressable channel such that the alert mechanism has an address unit that is different than an address unit of the display. The different address units enable the alert mechanism and the display to be individually addressable and thus separated controlled/activated.

In another embodiment, the textual notification device includes a system controller. In one application, the system controller is used for signaling the alert mechanism to generate the alert signal. The system controller can also be used for overriding the presentation of non-emergency information on the display when emergency information is received at the network interface.

In general, according to another aspect, the invention features an emergency system including a textual notification device. The textual notification device includes a display for presenting either emergency information or non-emergency information. Also, the textual notification device includes an alert mechanism for generating an alert signal for alerting occupants to the presentation of the emergency information. The emergency system includes an emergency panel for sending emergency information to the textual notification device. Also, the emergency system includes a secondary system for sending non-emergency information to the textual notification device.

In one embodiment, the emergency system further includes at least one initiation device coupled to the emergency panel. The at least one initiation device can be selected from the group including smoke detectors, pull stations, gas detectors, heat detectors, and combinations thereof.

In embodiments, the emergency system includes an addressable channel. In one application, the addressable channel extends between the emergency panel, the textual notification device, and other devices. The addressable channel enables the emergency panel to supervise and individually control the textual notification device.

In one embodiment, the emergency system further includes an audio/text converter. The audio/text converter utilizes the emergency information or non-emergency information to generate an audible message for broadcast in conjunction with the presentation of either the emergency information or non-emergency information, respectively. In one application, the audio/text converter includes a text-to-speech converter. In another application, the audio/text converter includes a speech-to-text converter.

In general, according to one aspect, the invention features a method of operating a textual notification device that includes the textual notification device receiving non-emergency information and emergency information, the textual notification device presenting either emergency information or non-emergency information on a display, and the textual notification device including an alert mechanism that generates an alert signal for alerting occupants to the presentation of the emergency information.

In one embodiment, the method further includes an emergency panel. In one application, the emergency panel individually addresses and controls an audio alert generator and a visual alert generator of the alert mechanism. In another application, the emergency panel individually addresses and controls the alert mechanism and the display.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1A:
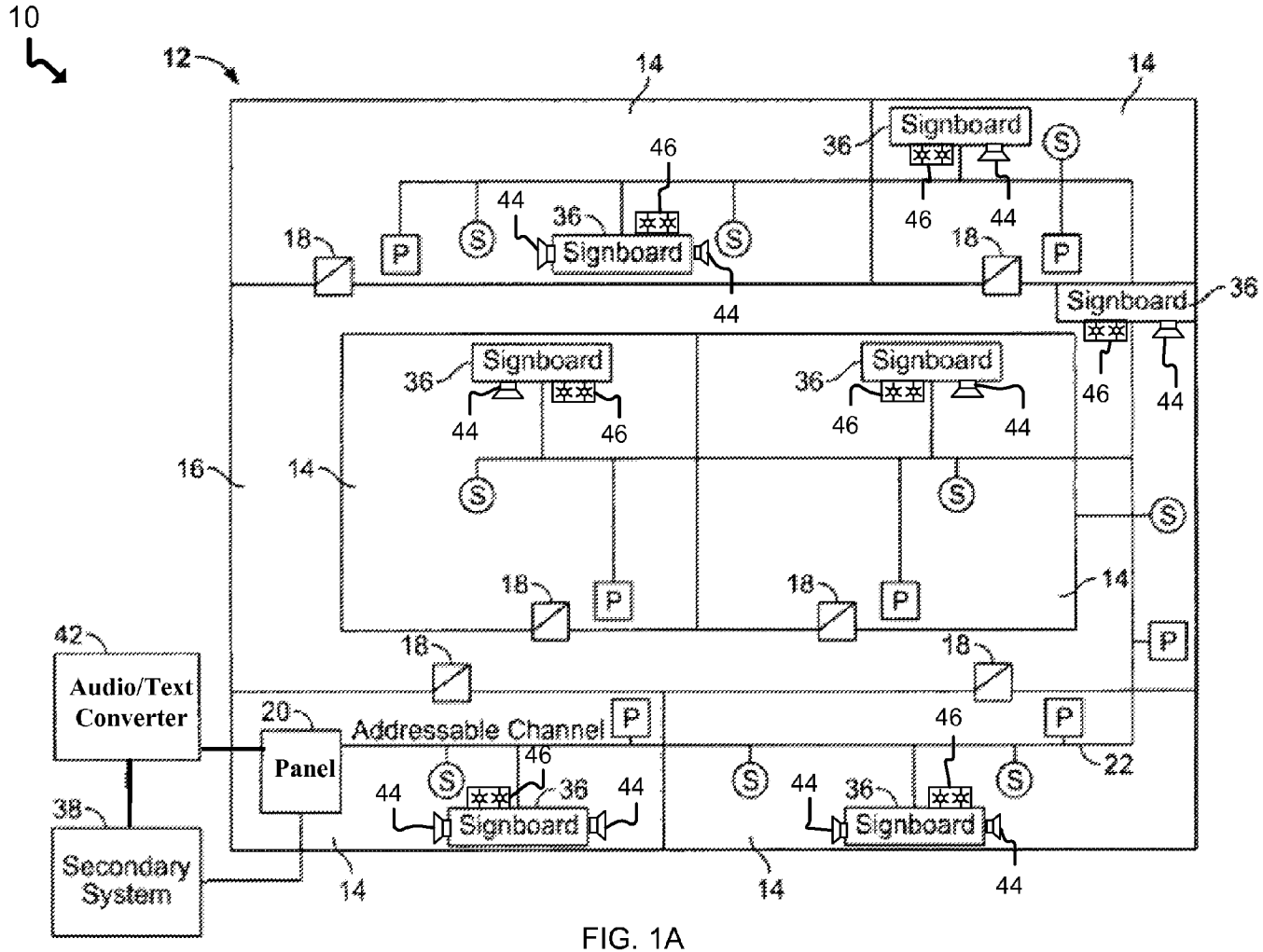
FIG. 1A is a schematic diagram of an emergency system including an emergency network.
Figure 1B:
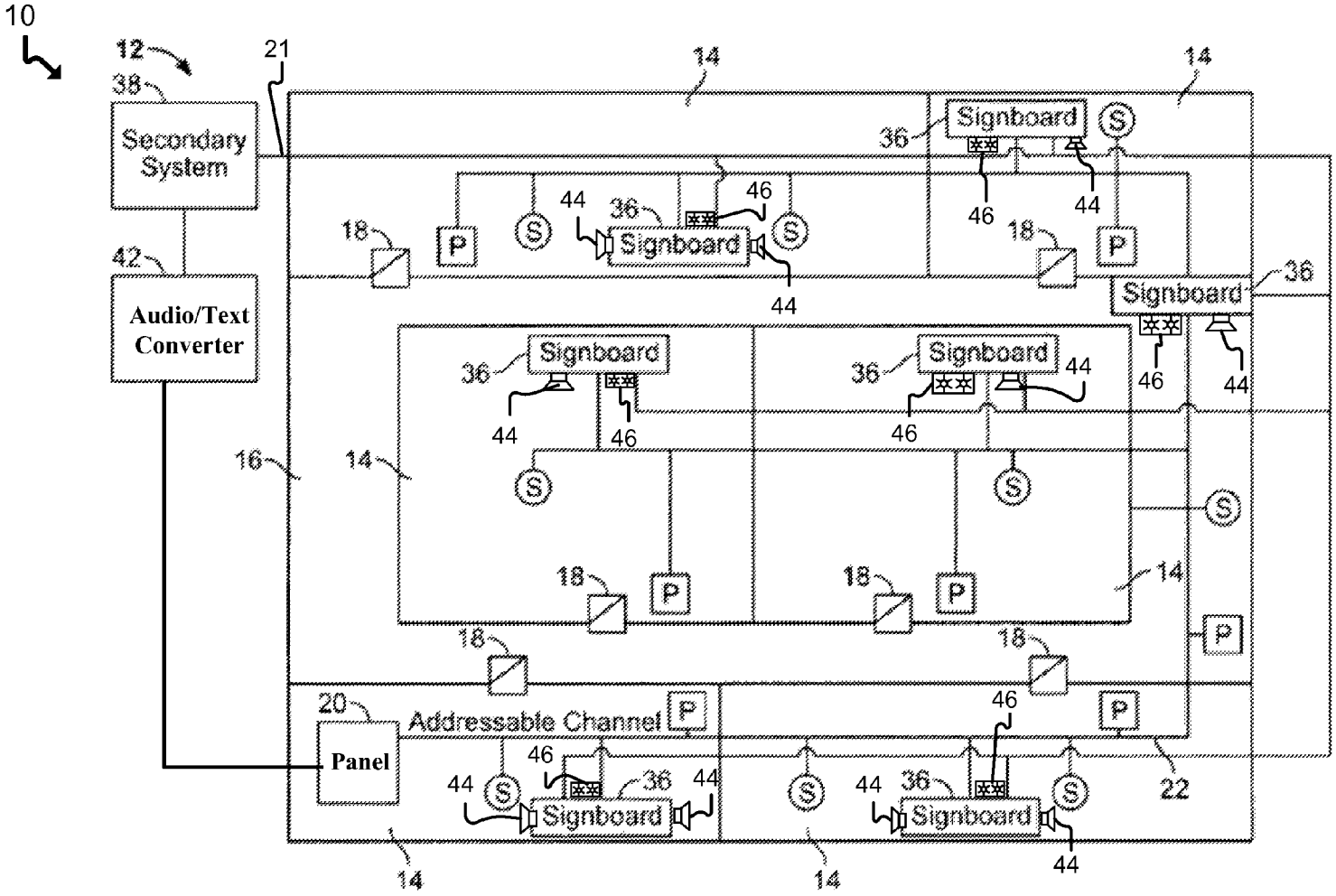
FIG. 1B is a schematic diagram of another emergency system including the emergency network and a non-emergency network.

FIGS. 1A and 1B show two different example emergency systems 10 constructed according to the principles of the present invention. FIG. 1A shows an emergency system 10 having one network (emergency network 22) whereas FIG. 1B shows an emergency system 10 having two networks (emergency network 22 and non-emergency network 21).

In general, the emergency system 10 is incorporated within an office building, school, hospital, factory, train station, airport terminal, or other public or private building. In the particular example illustrated, the emergency system 10 is implemented on a floor 12 of a single level building or a multi-story building. The floor 12 includes a number of rooms 14. The floor 12 includes a hallway 16 that provides ingress and egress to and from the rooms 14. Each room 14 is accessible from the hallway 16 by a door 18.

The emergency system 10 utilizes an emergency network 22 to communicate information between devices that are connected to the emergency network 22. These devices can be hard wired or wirelessly interconnected via the emergency network 22.

Initiation devices such as smoke detectors S and pull stations P are connected to the emergency network 22. Other initiation devices can include toxic or flammable gas detectors, heat detectors, or any variety of other types of emergency detectors as appreciated by one of skill in the art. Preferably in fire detection practice, each room 14 and hallway 16 should include at least one such initiation device.

Typically, standard notification devices are connected to the emergency network 22 for alerting occupants of an emergency. Standard notification devices can include audio alert generators (e.g., horns, sirens), visual alert generators (e.g., strobe lights, flashing LED arrays), or a combination thereof (A/V devices).

The emergency system 10 includes textual notification devices 36 for alerting occupants of an emergency. Each textual notification device 36 is in communication with the emergency network 22. As with the initiation devices (e.g., smoke detectors S and pull stations P), each room 14 and hallway 16 should preferably include at least one textual notification device 36. The textual notification device 36 is configured to display either emergency information or non-emergency information in the form of graphical and/or textual messages to occupants.

Each textual notification device 36 includes an alert mechanism 40. In example embodiments, the alert mechanism 40 includes an audio alert generator 44 and a visual alert generator 46. In other example embodiments, the alert mechanism 40 includes only the audio alert generator 44 or the alert mechanism 40 includes only the visual alert generator 46. Using device programming, the alert mechanism 40 brings attention to emergency information presented on the textual notification device 36 by generating an alert signal. The alert signal can be in the form of an audible signal (generated by the audio alert generator 44) and/or visible signal (generated by the visual alert generator 46). In alternative embodiments, the alert mechanism 40 includes an alert generator that generates alert signals in the form of other stimuli signals as appreciated by one of skill in the art. The textual notification device 36 can include one audio alert generator 44 or multiple audio alert generators 44. Similarly, the textual notification device 36 can include one visual alert generator 46 or multiple visual alert generators 46. The alert mechanism 40 can include various combinations of audio alert generators 44 and/or visual alert generators 46 in terms of quantity and size as appreciated by one of skill in the art.

The emergency system 10 includes an emergency panel 20. The emergency panel 20 provides system power, system control, and system supervision. The emergency panel 20 is coupled to at least one initiation device (e.g., smoke detector S, pull station P). This allows for the emergency panel 20 to monitor the at least one initiation device with respect to emergency conditions. When an emergency condition is sensed (e.g., smoke detected), the emergency panel 20 signals an emergency (e.g., fire) by communicating emergency information to the appropriate textual notification devices 36 via the emergency network 22. Emergency information can be any information relevant to the detection of an emergency such as a fire, gas leak, robbery, flood, utility failure, severe weather, or any other hazard appreciated by one of skill in the art.

The emergency network 22 includes an addressable channel. As illustrated in FIGS. 1A-1B, the addressable channel is coupled between the initiation devices (e.g., smoke detectors S and pull stations P), textual notification devices 36, and the emergency panel 20. The emergency panel 20 uses this addressable channel to provide system power, system control, and system supervision to devices on the emergency network 22. In one example, the addressable channel incorporates notification appliance circuits (NACs), ID circuits, or IDNet circuits as part of the emergency network 22. The addressable channel allows for each device to be individually addressable (i.e., controlled separately) within the emergency system 10.

The textual notification devices 36 are connected to the addressable channel on the emergency panel 20. This allows the emergency panel 20 to supervise and individually control each textual notification device 36. Each textual notification device 36 can be supervised, controlled, and powered directly by the emergency panel 20 via the addressable channel. For example, the emergency panel 20 can send emergency information to all or specific addressable textual notification devices 36. The emergency panel 20 can periodically communicate with the textual notification devices 36 even when the emergency system 10 is idle. If a component of a textual notification device 36 fails, or if a textual notification device 36 stops responding to these communications, a trouble condition may be indicated on the emergency panel 20 so that a user is made aware and can make appropriate repairs.

As described above, the textual notification device 36 is configured to present non-emergency information. The source of the non-emergency information is a secondary system 41. This secondary system 41 can be a server or other external device. The non-emergency information could be for general purpose notifications such as upcoming events at a school, commercial information (e.g., store or shopping mall specials), weather information, sports information, local news, time of day, corporate announcements, etc.

In FIG. 1A, the secondary system 38 provides this non-emergency information (i.e., day to day messaging) to the textual notification devices 36 via the emergency network 22. In particular, the secondary system 38 supplies non-emergency information directly to the emergency panel 20. Then, the emergency panel 20 delivers this non-emergency information to the textual notification device 36 via the emergency network 22. The textual notification device 36 considers emergency information as higher priority than non-emergency information so that emergency information always overrides non-emergency information in terms of presentation.

For the embodiment illustrated in FIG. 1B, non-emergency information is supplied via a non-emergency network 21. The non-emergency network 21 functions in parallel with the emergency network 22. The non-emergency network 21 can be provided in the form of wired or wireless communication. In this example embodiment, the secondary system 38 communicates non-emergency information to the textual notification devices 36 along the non-emergency network 21. Each textual notification device 36 includes two inputs: one input from the emergency panel 20 providing emergency information and a second input from the secondary system 38 providing non-emergency information. The non-emergency information is displayed on the textual notification devices 36 as long as there is no emergency information received from the emergency panel 20. Any emergency information received from the emergency panel 20 via the emergency network 22 takes priority over the non-emergency information received from the secondary system 38 via the non-emergency network 21.

In a further embodiment, the emergency system 10 includes an audio/text converter 42. The audio/text converter 42 utilizes emergency information or non-emergency information to generate an audible message for broadcast in conjunction with the presentation of either the emergency information or non-emergency information on the textual notification device 36. In one example embodiment, the audio/text converter 42 transforms non-emergency information or emergency information from text message form to audible message form. In this example, the audio/text converter 42 includes a text-to-speech converter for converting textual messages (e.g., predefined/canned text messages such as SMS/MMS or iMessage) into audible messages for broadcast. This broadcast can be provided on the audio alert generator 44 of the alert mechanism 40 or via a building speaker system. In an alternative example embodiment, the audio/text converter 42 includes a speech-to-text converter that converts audible messages into textual message (e.g., audio/text converter 42 transforms audible messages broadcast on a public address system to text messages for display on the textual notification device 36). These audible messages or textual messages can be fed into the textual notification device 36 as previously described (e.g., via the emergency network 22 or non-emergency network 21). The audio/text converter 42 allows for the textual notification device 36 to present emergency information or non-emergency information while simultaneously broadcasting this same information as audible messages.

Figure 2A:
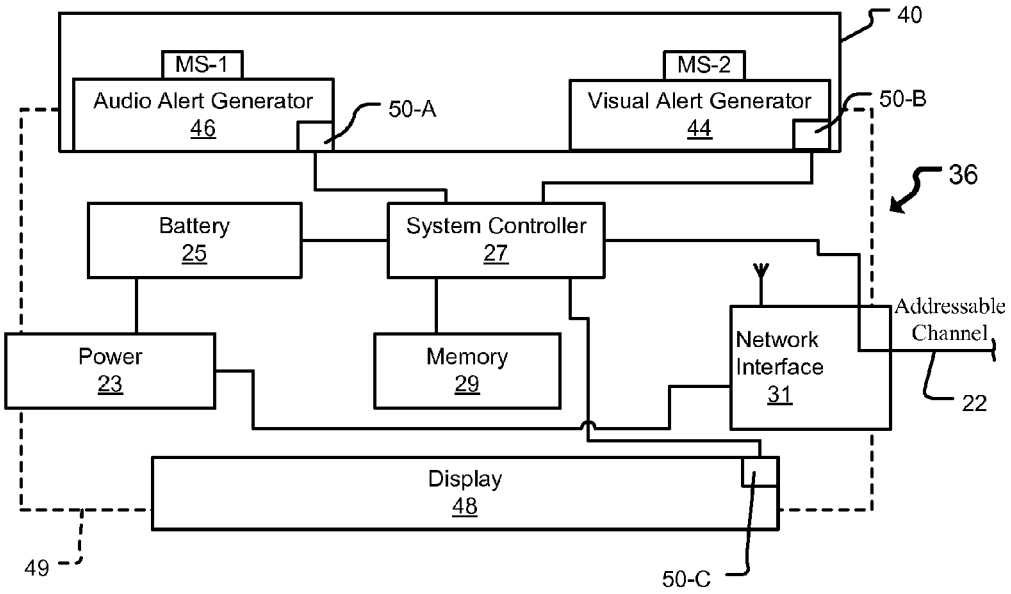
FIG. 2A is a block diagram of the textual notification device of the emergency system of FIG. 1A.
Figure 2B:
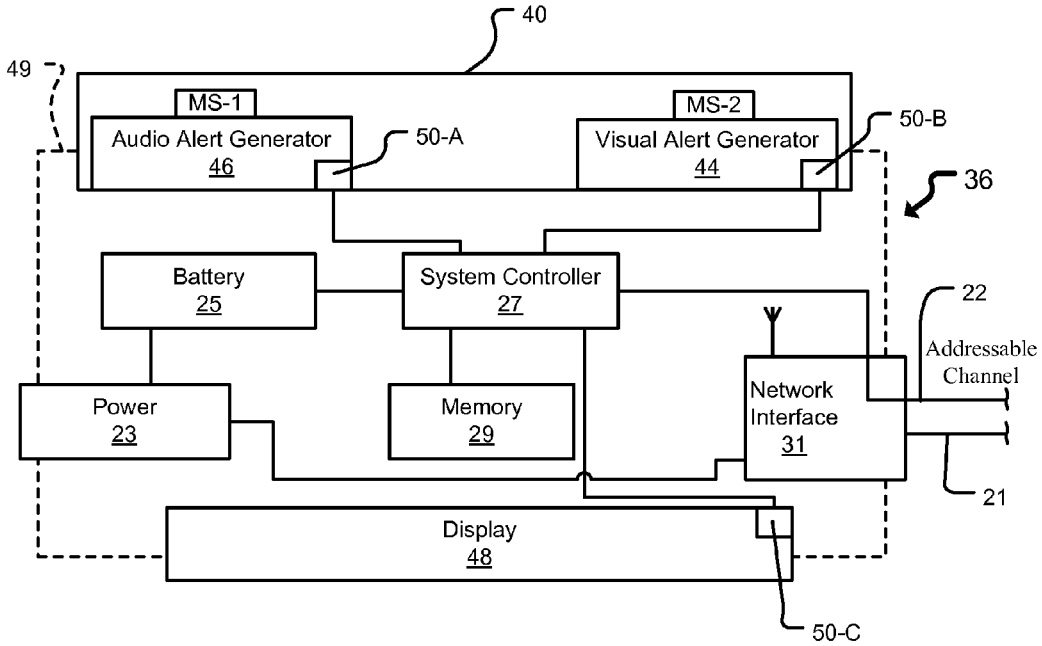
FIG. 2B is a block diagram of the textual notification device of the emergency system of FIG. 1B.

FIGS. 2A and 2B illustrate block diagrams of two different embodiments of the textual notification device 36. These figures illustrate the main components of the textual notification device 36 within a housing 49.

The textual notification device 36 includes a network interface 31 that is connected to the emergency network 22. The network interface 31 is configured to provide wired or wireless communication. The network interface 31 receives emergency information from the emergency panel 20 and non-emergency information from the secondary system 41. In the FIG. 2A example embodiment, the network interface 31 includes one input that receives emergency information and non-emergency information via the emergency network 22 (implemented in FIG. 1A). In the FIG. 2B example embodiment, the network interface 31 includes two inputs where a first input is connected to the emergency network 22 and a second input is connected to the non-emergency network 21 (implemented in FIG. 1B). In FIG. 2B, the network interface 31 receives emergency information via the emergency network 22 (i.e., first input) and non-emergency information via the non-emergency network 21 (i.e., second input).

The textual notification device 36 has a display 48 for presenting either emergency information or non-emergency information received at the network interface 31. The display 48 can include light emitting diodes (LEDs), a liquid crystal display (LCD), a cathode ray tube (CRT), projection display, or the like to present emergency information or non-emergency information in the form of text messages and/or graphical images. In one example, the display 48 is an LED signboard.

As shown in FIGS. 2A-2B and described above, the textual notification device 36 has an alert mechanism 40 that is located within the same housing as the display 48 to form a single unitary device that is powered by a common power supply 23. The alert mechanism 40 generates an alert signal for alerting occupants to the presentation of emergency information on the display 48. In particular, the alert mechanism 40 can generate audible and/or visible alert signals for indicating the presentation of emergency information on the display 48. In one example, the audible and visible alert signals of the alert mechanism 40 are Americans with Disabilities Act (ADA) compliant particularly for hearing impaired occupants. Example ADA compliance for hearing impaired occupants can include high decibel audible alert signals and/or high candela visible alert signals.

The alert mechanism 40 includes a visual alert generator 46 for providing the visible alert signals. In one example, the visual alert generator 46 is a strobe light or LED. In particular, the strobe light or LED can be static or variable. As a variable strobe light, the visual alert generator 46 is configured to generate different flash frequencies. The different flash frequencies can be used to indicate different emergency conditions (e.g., rate of flash relates to particular emergency condition). The range of flashes for the visual alert generator 46 can be between about 1 to about 2 flashes per second. In another example, each visual alert generator 46 is configured to generate visible signals as one or more colors. In this color example, the visual alert generator 46 indicates different emergency conditions by flashing different colors (e.g., fire alert is red whereas gas alert is blue). This color example can alternatively be accomplished with multiple visual alert generators 46 each generating a different color. In example embodiments, the visual alert generator 46 generates visible signals having a luminous intensity range of about 15 candelas to about 1000 candelas. In one example, the visual alert generator 46 is a candela Xenon strobe light. In another example, the visual alert generator 46 is a light-emitting diode (LED) strobe light or translucent strobe light. In other examples, the visual alert generator 46 can include LEDs, incandescent lights, or other elements configured to provide visible signals as appreciated by one of skill in the art.

The alert mechanism 40 includes an audio alert generator 44 for providing audible alert signals. In example embodiments, the audio alert generator can be a sounder, speaker, siren, horn, bell, or other audio device configured to provide audible alert signals as appreciated by one of skill in the art. The audio alert generator 44 can generate at least one tone. In one example, the audio alert generator 44 generates multiple tones. The audio alert generator 44 can generate multiple tones or a pattern of one or more tones to indicate a particular emergency condition (e.g., fire alert is low tone whereas gas alert is high tone). In example embodiments, the audio alert generator 44 can generate audible alert signals having a frequency of about 520 Hz or alternatively about 3000 Hz. In example embodiments, the audio alert generator 44 is configured to generate audible signals in the form of audible voice message sounds, siren sounds, bell sounds, beeping sounds, or other sounds as appreciated by one of skill in the art.

The textual notification device 36 includes the power source 23 that provides system power for the textual notification device 36. This power source 23 is received from either the emergency panel 20 via the emergency network 22 or from building AC power. A battery 25 is connected to the power source 23 for providing backup power to the components of the textual notification device 36.

The textual notification device 36 includes a system controller 27. The system controller 27 is in communication with the emergency panel 20 and the secondary system 41 via the network interface 31. The system controller 27 provides control and supervision of the components in the textual notification device 36 in response to this communication. In an example embodiment, the system controller 27 manages activation of the alert mechanism 40 based on communications with the emergency panel 20. The system controller 27 activates or signals the alert mechanism 40 to generate an alert signal (e.g., the audio alert generator 44 generates audible signals and/or the visual alert generator 46 generates visible signals) for a predetermined period of time. The system controller 27 directs this activation or signaling when emergency information is presented on the display 48 or prior to presenting emergency information on the display 48. The system controller 27 overrides presentation of non-emergency information on the display 48 when emergency information is received from the emergency panel 20.

The system controller 27 is configured to provide a "self-test" for the alert mechanism 40. For example, starting the "self-test" manually initiates the system controller 27 to direct the alert mechanism 40 to test the functionality of the audio alert generator 44 and visual alert generator 46.

In one example, the "self-test" is activated by a manual switch MS. This manual switch MS polled by the system controller 27 such that when a technician depresses the manual switch MS, the system controller 27 begins a self test of the alert mechanism 40. Preferably, the manual switch is attached to the housing of the alert mechanism 40.

Alternatively, as illustrated in FIGS. 2A-2B, the manual switches MS-1, MS-2 are associated and preferably attached to the visual alert generator 44 and the audio alert generator 46, respectively. These separate switches enables the initiation of a "self-test" separately for each alert generator 44, 46 of the alert mechanism 40. For example, a first "self-test" is performed for the audio alert generator 44 by the technician depressing a first manual switch MS-1 and a second "self-test" is performed for the visual alert generator 46 by the technician depressing a second manual switch MS-2. The "self-test" is deemed successful, for example, if the visual alert generator 46 responds with a pulse of light and the audio alert generator 44 responds with a tone.

The textual notification device 36 includes memory 29. The memory 29 stores a variety of information used by the system controller 27 to manage the components of the textual notification device. For example, the memory 29 includes pre-programmed emergency text messages (i.e., emergency information) that are activated by the system controller 27 based on a particular emergency condition. Alternatively, the emergency panel 20 provides the emergency text messages which may be stored in the memory 29.

In an alternative embodiment, the textual notification device 36 does not include a system controller 27. In this embodiment, the emergency panel 20 replaces the system controller 27 functionality in directing presentation of emergency information whereas the secondary system 41 replaces the system controller 27 functionality in directing presentation of the non-emergency information. In this example embodiment, the emergency panel 20 controls the alert mechanism 40 (i.e., activates the alert mechanism 40 to generate alert signal) with respect to presentation of emergency information.

The textual notification device 36 has an On/Off function for turning "On" or turning "Off" components (e.g., display 48 or alert mechanism 40) of the textual notification device 36. In one example, the alert mechanism 40 has an On/Off function distinct from the On/Off function of the textual notification device 36. These On/Off functions can be controlled by the system controller 27 and/or the emergency panel 20.

The alert mechanism 40 has a duration function that provides control of the duration of audible signals (e.g., tones) and visible signals (e.g., light pulses). This duration function can be controlled by the system controller 27 and/or the emergency panel 20.

In example embodiments, the system controller 27 and/or the emergency panel 20 contain defaults set by the manufacturer with respect to generally controlling the textual notification device 36.

In an example embodiment, as shown in FIGS. 2A-2B, the components of the textual notification device 36 are coupled to the addressable channel of the emergency network 22. This addressable channel allows for the different components of the textual notification device 36 to be controlled distinctly and separately (e.g., individually programmed and used) from one another. For example, the alert mechanism 40 and the display 48 have separate distinct addresses or address units (50-A/50-B vs. 50-C, respectively) from one another. The alert mechanism 40 can be separated further such that the audio alert generator 44 and the visual alert generator 46 have separate distinct addresses and address units (50-A vs. 50-B respectively) from one another. In particular, as illustrated in FIGS. 2A-2B, the audio alert generator 46 has a first address unit 50-A, the visual alert generator 44 has a second address unit 50-B, and the display 48 has a third address unit 50-C allowing the audio alert generator 46, the visual alert generator 44, and display 48 to be individually addressable and thus controlled by the emergency panel for example. Each address unit 50-A, 50-B, 50-C is coupled to the addressable channel via the system controller 27. This addressable channel enables the emergency panel 20 to separately control the components of the textual notification device 36 via the emergency network 22 and system controller 27. In one application, the audio alert generator 46, the visual alert generator 44, and the display 48 are each connected to the addressable initiating device circuits (e.g., NACs, ID circuits, or ID net circuits). For example, each address unit 50-A, 50-B, 50-C corresponds to a distinct circuit board with a distinct address connected to the addressable initiating device circuits. In another example, multiple alert generators (e.g., multiple visual alert generators 44) are addressable via a single circuit board with one address.

For example, the emergency panel 20 can direct the following ordered actions: presentation of emergency information on the display 48 by sending the emergency information over the addressable channel addressed to the display 48, then pulse the visual alert generator 46 by sending a pulse command over the addressable channel addressed to the visual alert generator 46, and then generate an audible signal via the audio alert generator 44 by sending a command over the addressable channel addressed to the audio alert generator 44.

In one example, this addressable channel allows for multiple colored visual alert generators 46 (e.g., different colored strobe lights) to be controlled separately from one another. Having the addressable channel allows for each colored visual alert generator 46 to be activated separately based on a particular emergency condition (e.g., fire alert is red strobe light whereas gas alert is blue strobe light).

Figure 3A:
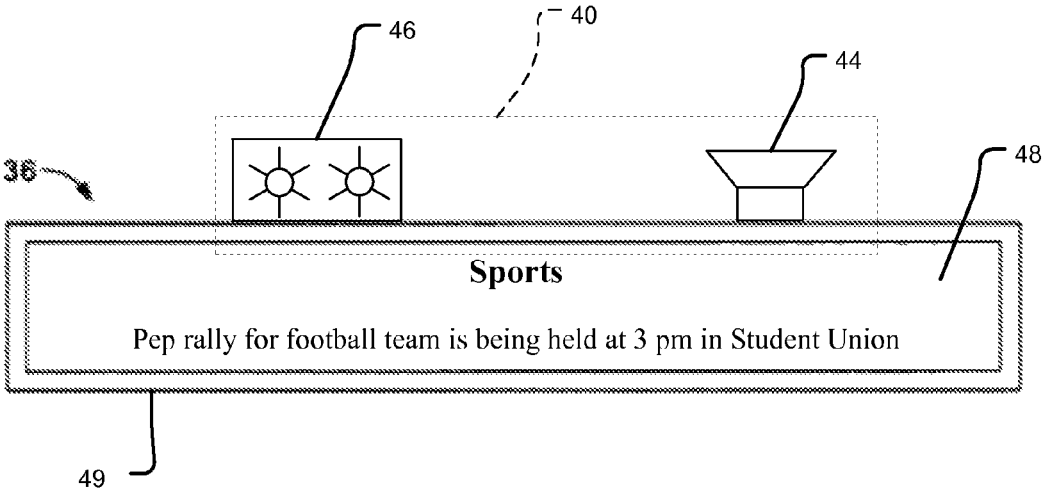
FIGS. 3A-3B are schematic diagrams of the textual notification device including an alert mechanism.
Figure 3B:
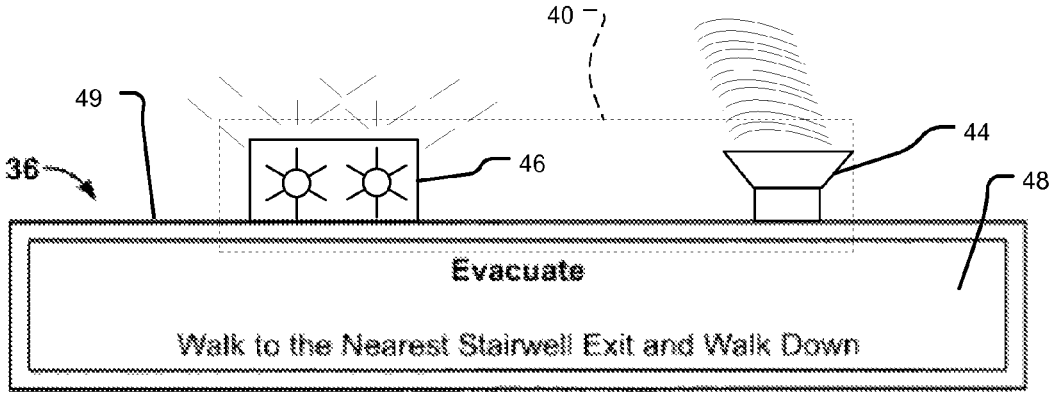

FIGS. 3A and 3B are schematic diagrams of the textual notification device 36 in operation. As shown in FIG. 3A, the alert mechanism 40 is off (i.e., not activated) when non-emergency information is shown on the display 48. Then, in FIG. 3B, the alert mechanism 40 is activated when emergency information is shown on the display 48. This activation of the alert mechanism 40 can include activating the visual alert generator 46 and/or the audio alert generator 44. As shown in FIG. 3B, the activation causes the visual alert generator 46 to produce a flashing light and the audio alert generator 44 to produce alarm sounds while emergency information is presented on the display 48.

The textual notification device 36 of FIGS. 3A-3B displays emergency information or non-emergency information using an LED signboard. This type of textual notification device 36 can display messages made of languages using graphical characters (e.g., Latin based characters or non-Latin based characters such as Arabic or Chinese).

In the example embodiment of FIGS. 3A-3B, the textual notification device 36 is a multi-line signboard. As a multi-line signboard, the textual notification device 36 includes a first line message that is constant. Examples of brief constant non-emergency messages can include: "Food special for the Day", "Weather forecast", "Local news updates", or "Sports" as provided in FIG. 3A. The non-emergency message can vary from location to location based on interest. Examples of brief constant emergency messages can include: "Shelter in Place", "Standby for Further Instructions", or "Evacuate" as provided in FIG. 3B. The brief instructional message can be adapted to display different messages depending on the emergency condition coming into the emergency system 10.

The multi-line signboard has a second line that includes an instructional message (i.e., emergency information) or non-emergency message (non-emergency information). This second line message can be scrolled across the LED display surface of the textual notification device 36. An example of a scrolled instructional message can include: "Do not use the elevators! Walk to the nearest stairwell exit and walk down to street level and exit the building". Because this is a scrolling message, the second line depicted in FIG. 3B shows only a portion of the scrolling message (with the missing portion of the message either previously scrolled or yet to be displayed). An example of a scrolled non-emergency message can include: "Pep rally for football team is being held at 3 pm in Student Union", as shown in FIG. 3A. The scrolled instructional message and non-emergency message can be adapted to display different messages depending on the emergency information coming from the emergency panel 20 or the non-emergency information coming from the secondary system 41.

Figure 4:
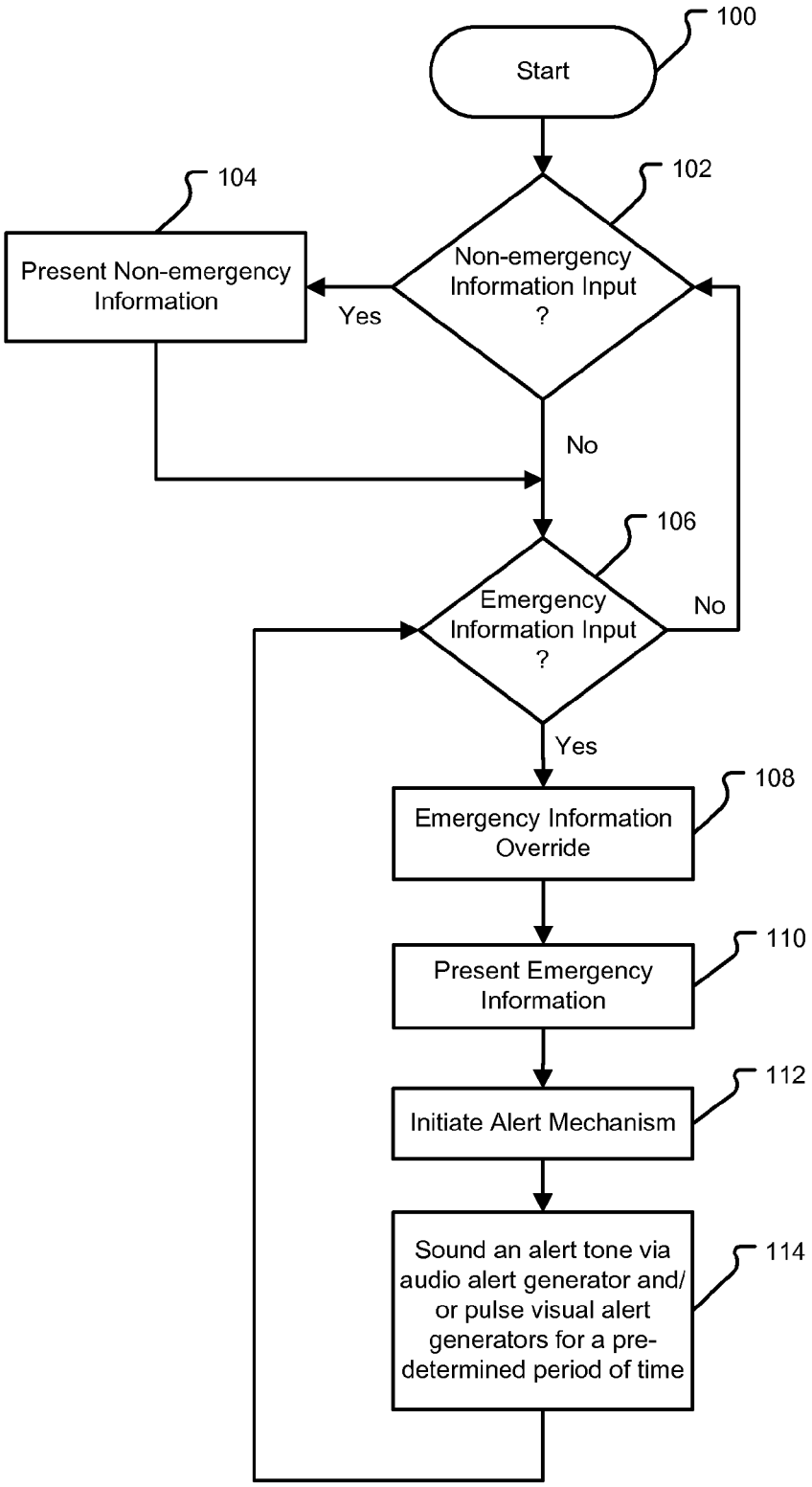
FIG. 4 is a flow chart illustrating the operation method of the textual notification device with the alert mechanism.

FIG. 4 is a flow chart illustrating the process of operation of the textual notification device 36. In particular, this process describes the feature of overriding non-emergency information as well as activating or signaling the alert mechanism 40 when emergency information is presented.

Initially, the process starts at step 100. In step 102, the textual notification device 36 uses the system controller 27 to determine if non-emergency information has been received from the secondary system 41 (i.e., non-emergency information inquiry). If non-emergency information has been received, then the textual notification device 36 presents the non-emergency information on the display 48 (step 104). If non-emergency information has not been received, then the process continues to step 106 (emergency information inquiry). In step 106, the system controller 27 of the textual notification device 36 is constantly monitoring for the existence of emergency information. If there is no emergency information received, then step 102 (non-emergency information inquiry) is repeated. If emergency information is received from the emergency panel 20, emergency information override occurs (step 108). During emergency information override (step 108), the system controller 27 overrides the presentation of non-emergency information when emergency information is received. In step 110, the system controller 27 initiates the presentation of emergency information on the display 48. In step 112, the system controller 27 initiates or activates the alert mechanism 40 (includes audio alert generator 44 and/or visual alert generator 46). This initiation causes the sounding of an alert tone via the audio alert generator 44 and/or pulsing of the visual alert generator 46 for a pre-determined period of time (step 114). After step 114, the process loops back to the emergency information inquiry (step 106) such that the emergency information is presented. Once again, if emergency information continues to be present, then emergency information override continues to occur. If emergency information is no longer present, then the process returns to the non-emergency information inquiry (step 102).

While this invention has been particularly shown and described with references to preferred embodiments thereof, it will be understood by those skilled in the art that various changes in form and details may be made therein without departing from the scope of the invention encompassed by the appended claims.

What is claimed is:

1. A textual notification device, comprising:

a network interface having a first input connected to a wired emergency network for receiving emergency information and a second input connected to a wired non-emergency network for receiving non-emergency information;

a light emitting diode (LED) display for presenting either the emergency information or the non-emergency information;

a system controller for overriding the presentation of non-emergency information on the LED display when emergency information is received at the first input of the network interface;

an audio alert generator for generating an audible signal and a visual alert generator for generating a visible signal when the emergency information is presented on the LEI) display;

wherein the emergency network provides wired communication between an emergency panel and the textual notification device and the non-emergency network provides wired communication between a secondary system and the textual notification device;

wherein the audio alert generator, the visual alert generator, and the LED display have different address units with different addresses on the wired emergency network, the different address units are connected to an addressable channel of the emergency network for enabling the audio alert generator, the visual alert generator, and the LED display to be individually addressable by the emergency panel using their different addresses; and wherein the audio alert generator, the visual alert generator, the LED display, the system controller, and the network interface are located in the same housing to form a single unitary device.

2. The textual notification device according to claim 1, wherein the alert signal corresponds with a particular emergency condition.

3. The textual notification device according to claim 1, wherein the system controller signals the alert mechanism to generate the alert signal.

4. The textual notification device according to claim 1, further comprising at least one initiation device coupled to the emergency panel.

5. The textual notification device according to claim 4, wherein the at least one initiation device is selected from the group comprising smoke detectors, pull stations, gas detectors, heat detectors, and combinations thereof.

6. The textual notification device according to claim 1, wherein an audio/text converter utilizes the emergency information or non-emergency information to generate an audible message for broadcast in conjunction with the presentation of either the emergency information or non-emergency information, respectively.

7. The textual notification device according to claim 6, wherein the audio/text converter comprises a text-to-speech converter.

8. The textual notification device according to claim 6, wherein the audio/text converter comprises a speech-to-text converter.

9. The textual notification device according to claim 1, wherein the alert mechanism is activated when the emergency information is presented on the display and the alert mechanism is off when non-emergency information is presented on the display.

10. The textual notification device according to claim 1, wherein the textual notification device further comprises a common power supply for powering the alert mechanism and the display.

* * * * *